US009976235B2

(12) United States Patent
Garcon et al.

(10) Patent No.: US 9,976,235 B2
(45) Date of Patent: May 22, 2018

(54) PREFORM AND KNITTED TUBULAR ITEM HAVING A RETAINING EDGE OF A SINGLE THICKNESS AND METHOD OF PRODUCING SUCH AN ITEM

(71) Applicant: HANES OPERATIONS EUROPE SAS, Rueil-Malmaison (FR)

(72) Inventors: Gilles Garcon, Saint Vallier (FR); Laurent Massotte, Tavernay (FR)

(73) Assignee: Hanes Operations Europe SAS, Rueil-Malmaison (FR)

( * ) Notice: Subject to any disclaimer, the term of this patent is extended or adjusted under 35 U.S.C. 154(b) by 413 days.

(21) Appl. No.: 14/436,273

(22) PCT Filed: Oct. 10, 2013

(86) PCT No.: PCT/FR2013/052413

§ 371 (c)(1),
(2) Date: Apr. 16, 2015

(87) PCT Pub. No.: WO2014/060682

PCT Pub. Date: Apr. 24, 2014

(65) Prior Publication Data

US 2015/0275407 A1 Oct. 1, 2015

(30) Foreign Application Priority Data

Oct. 16, 2012 (FR) ..... 12 59871

(51) Int. Cl.
*D04B 1/24* (2006.01)
*D02G 3/38* (2006.01)
(Continued)

(52) U.S. Cl.
CPC ..... *D04B 1/24* (2013.01); *D02G 3/385* (2013.01); *D02G 3/406* (2013.01); *D04B 1/10* (2013.01);
(Continued)

(58) Field of Classification Search
CPC ... D04B 1/24; D04B 1/12; D04B 1/18; D04B 9/48; D04B 1/10; D04B 1/106; D04B 1/26
See application file for complete search history.

(56) References Cited

U.S. PATENT DOCUMENTS 2,342,098 A * 2/1944 Alderfer ..... D02G 3/32 139/420 R
3,392,553 A 7/1968 Burleson
(Continued)

FOREIGN PATENT DOCUMENTS

CN 1336971 A 2/2002
CN 1665409 A 9/2005
(Continued)

OTHER PUBLICATIONS

The State Intellectual Property Office of the People's Republic of China, Notification of the First Office Action, Chinese Application No. 2013800529805, dated Apr. 22, 2016, 6 pages.
(Continued)

*Primary Examiner* — Danny Worrell
(74) *Attorney, Agent, or Firm* — Fish & Richardson P.C.

(57) ABSTRACT

The method of producing a tubular knitted item (10), in particular a leg for a pair of tights, involves preceding the normal basic knit with a start that involves knitting, on only a portion of the needles on p first courses (11, 12) and on all of the needles on q subsequent courses (13, 14), an elastane yarn (21) covered with a water-soluble yarn (22); then, once the item has been knitted, the item undergoes an aqueous treatment, for example combined with dyeing, so as to make the water-soluble yarn (22) covering disappear, whereby the p+q courses (11-14) of knitted elastane that precede the normal basic knit are kept on the edge of the item.

19 Claims, 1 Drawing Sheet

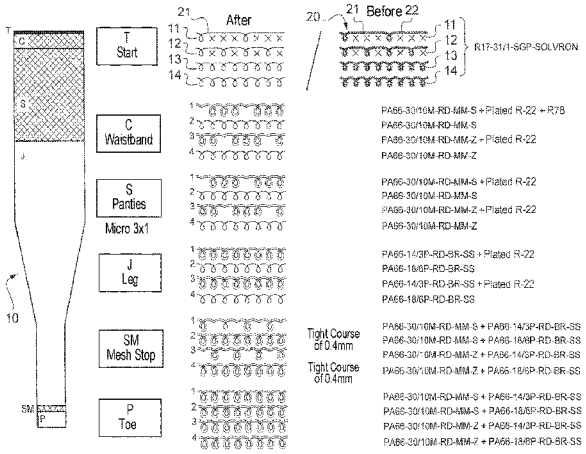

(51) Int. Cl.

| | |
|---|---|
| ***D04B 1/10*** | (2006.01) |
| ***D02G 3/40*** | (2006.01) |
| ***D04B 1/26*** | (2006.01) |
| ***D06B 1/00*** | (2006.01) |
| ***D06B 11/00*** | (2006.01) |
| ***D06F 7/00*** | (2006.01) |

(52) U.S. Cl.
CPC ..... *D04B 1/106* (2013.01); *D04B 1/26* (2013.01); *D06B 1/00* (2013.01); *D06B 11/00* (2013.01); *D06F 7/00* (2013.01)

(56) References Cited

U.S. PATENT DOCUMENTS

| | | | | | |
|---|---|---|---|---|---|
| 5,062,161 | A * | 11/1991 | Sutton | A41D 31/0055 | 2/169 |
| 5,280,652 | A * | 1/1994 | Davis | D04B 1/106 | 2/239 |
| 5,442,815 | A * | 8/1995 | Cordova | A61B 42/10 | 2/161.7 |
| 6,803,332 | B2 * | 10/2004 | Andrews | D02G 3/12 | 428/377 |
| 7,000,295 | B2 * | 2/2006 | Andrews | D02G 3/12 | 28/168 |
| 7,634,923 | B2 * | 12/2009 | Fujita | D02G 3/32 | 66/172 E |
| 2002/0187345 | A1 * | 12/2002 | Andrews | D01D 5/12 | 428/364 |
| 2003/0192157 | A1 * | 10/2003 | Andrews | D02G 3/12 | 28/170 |
| 2005/0069685 | A1 | 3/2005 | Andrews | | |
| 2006/0150378 | A1 * | 7/2006 | Andrews | D02G 3/12 | 28/168 |
| 2009/0044572 | A1 * | 2/2009 | Fujita | D02G 3/32 | 66/177 |

FOREIGN PATENT DOCUMENTS

| | | | |
|---|---|---|---|
| CN | 101351586 | A | 1/2009 |
| EP | 0034981 | A1 | 9/1981 |
| EP | 0037629 | A1 | 10/1981 |
| EP | 0556068 | A1 | 8/1993 |
| EP | 1956125 | A1 | 8/2008 |
| FR | 2272213 | A1 | 12/1975 |
| FR | 2819827 | A1 | 7/2002 |
| FR | 2942109 | A1 | 8/2010 |
| FR | 2946668 | A1 | 12/2010 |
| GB | 1427777 | A | 3/1976 |
| JP | H0544130 | A | 2/1993 |
| TW | 201233858 | A | 8/2012 |

OTHER PUBLICATIONS

International Search Report dated Jan. 15, 2014 re: Application No. PCT/FR2013/052413; citing: EP 1 956 124 A1, EP 0 556 068 A1 and US 2005/069685 A1.

* cited by examiner

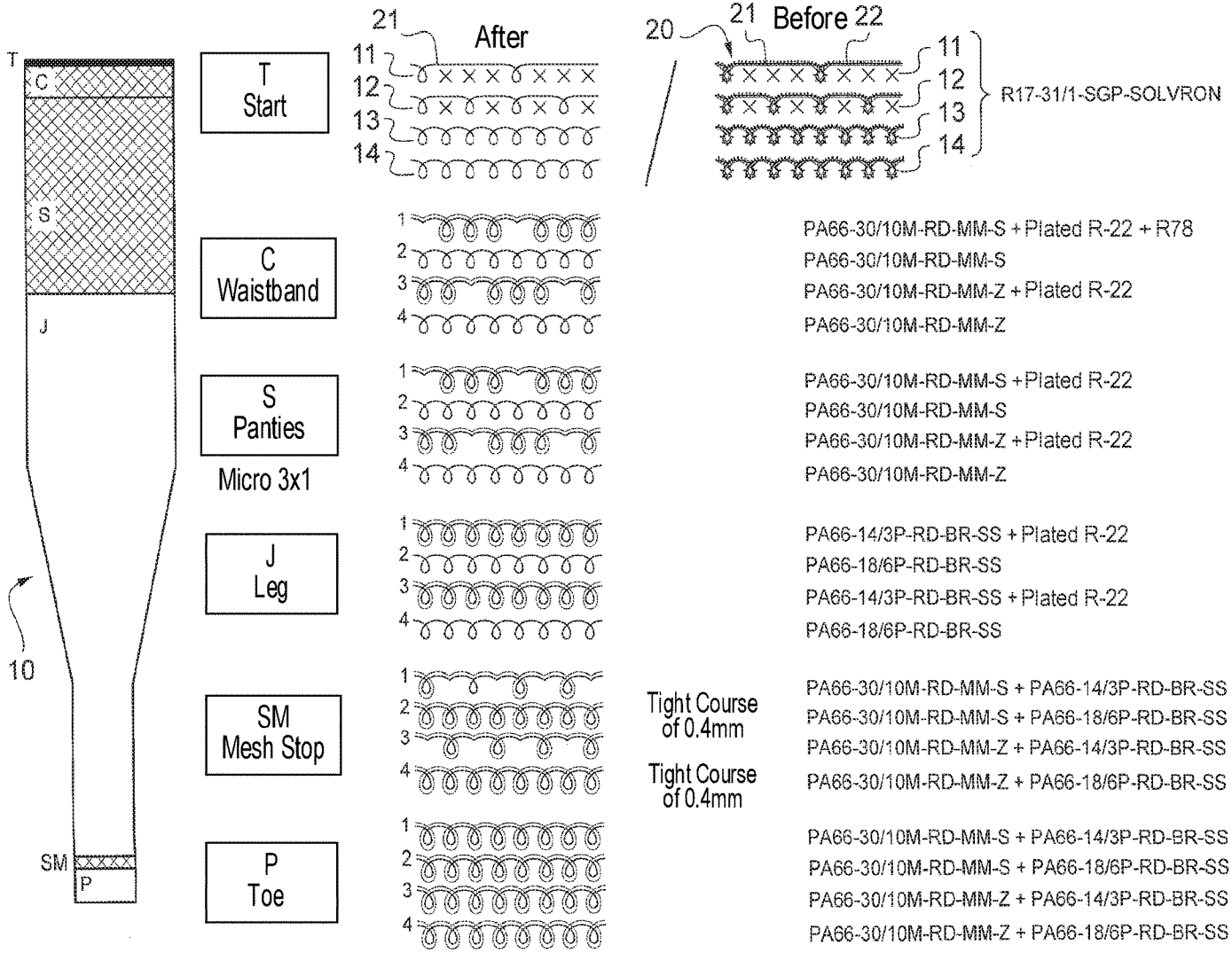
Before 22
After
20
21
11
12
13
14
R17-31/1-SGP-SOLVRON
PA66-30/10M-RD-MM-S + Plated R-22 + R78
PA66-30/10M-RD-MM-S
PA66-30/10M-RD-MM-Z + Plated R-22
PA66-30/10M-RD-MM-Z
PA66-30/10M-RD-MM-S + Plated R-22
PA66-30/10M-RD-MM-S
PA66-30/10M-RD-MM-Z + Plated R-22
PA66-30/10M-RD-MM-Z
PA66-14/3P-RD-BR-SS + Plated R-22
PA66-18/6P-RD-BR-SS
PA66-14/3P-RD-BR-SS + Plated R-22
PA66-18/6P-RD-BR-SS
PA66-30/10M-RD-MM-S + PA66-14/3P-RD-BR-SS
PA66-30/10M-RD-MM-S + PA66-18/6P-RD-BR-SS
PA66-30/10M-RD-MM-Z + PA66-14/3P-RD-BR-SS
PA66-30/10M-RD-MM-Z + PA66-18/6P-RD-BR-SS
PA66-30/10M-RD-MM-S + PA66-14/3P-RD-BR-SS
PA66-30/10M-RD-MM-S + PA66-18/6P-RD-BR-SS
PA66-30/10M-RD-MM-Z + PA66-14/3P-RD-BR-SS
PA66-30/10M-RD-MM-Z + PA66-18/6P-RD-BR-SS
Tight Course of 0.4mm
Tight Course of 0.4mm
T Start
C Waistband
S Panties
Micro 3x1
J Leg
SM Mesh Stop
P Toe
T
C
S
J
SM
P
10

PREFORM AND KNITTED TUBULAR ITEM HAVING A RETAINING EDGE OF A SINGLE THICKNESS AND METHOD OF PRODUCING SUCH AN ITEM

TECHNICAL FIELD

The present invention relates to a knitted textile item, comprising a tubular part terminated by a retaining edge.

The invention relates more particularly to a pair of tights of which the retaining edge is constituted by the waistband part which surrounds the waist of the wearer. It may relate to other knitted tubular items, in particular items for the lower body, such as panties or footwear items intended for dressing the lower body to the foot, in particular, apart from the already mentioned pair of tights, stockings, knee-high stockings, socks and even high socks. The retaining edge is typically achieved in the form of an extensible knitted strip suitable for exerting a retaining pressure of the item in place, a pressure higher than that exerted by the rest of the item, particularly the tubular part thereof.

BACKGROUND

In the case of a footwear item, in order to ensure the hold on the leg while preventing the item from rolling, the retaining edge is usually made by a rib trimming in a double knit layer, of which the dimensions and texture vary according to the features of construction and thickness of the tubular part of the item. This technique is illustrated for knee-high stockings in document FR 2 946 668.

It is known, for example by documents GB 1 427 777, EP 0 034 981 or FR 2 819 827, to produce a pair of tights by knitting two tubes on a circular knitting machine, by opening the top of each tube along a substantially vertical seaming and by assembling by confection the two tubes at the edges of said seamings in such a manner as to form the panty part of the pair of tights. The waistband part of the pair of tights may be formed by sewing an added waistband strip or more traditionally by a double knit layer obtained during the knitting itself and of which the dimensions and texture vary according to the features of construction and thickness of the part below the waistband. This double thickness may be obtained by knitting a welt which is fastened by knitting to the tube of the item, according to what is called "hanging plate"; this double layer part visually offers a rather significant demarcation with the rest of the outline, which may even be visible beneath clothes. With the purpose of reducing this traditional double layer, it has been proposed in document FR 2 942 109 a fine elastic knitted lingerie item, having an elastic retaining edge, comprising a fine elastic knit layer and a strip of elastic material thermally bonded on said fine elastic knit layer, this elastic material being also advantageously knitted in fine knit. Although this item is very popular, it requires an additional thermal bonding operation in the production of the pair of tights.

It would be desirable to propose items with a single thickness waistband without demarcation, obtained directly by knitting on a circular knitting machine.

However, in practice it is difficult to obtain a satisfactory retaining edge by knitting such an item on a circular knitting machine. For technical reasons, the first knitted courses cannot be knitted on all the needles, as opposed to the "normal" courses of the basic tubular item; for example first they are knitted 1 needle out of 4, then 1 needle out of 2; hence, in these first courses there is less length of absorbed yarn (LFA) and consequently these first courses have less extensibility than the subsequent courses and those of the rest of the item, thus making the item more constraint at the edge of the waistband than on the rest of the item; it is a cause of discomfort for the wearer. Hence, in many cases one is compelled to have to cut this edge, thereby leading to an additional operation and a loss of time, thus also leading to an edge of a quality which is not necessarily irreproachable, possibly with the risk of the item running.

BRIEF SUMMARY

The purpose of the invention is to propose a method of producing and a tubular item thus produced which do not have these drawbacks.

The invention reaches its purpose by a method of producing a knitted tubular item according to which the item is knitted on a circular knitting machine provided with an n number of needles and a c number of feeders, the knit being at the start knitted on a p number of first courses on only some of the n needles before being knitted on all the needles on a q number of subsequent courses, after which the basic knit is knitted normally, characterized in that it is knitted on said p first courses and on said subsequent q courses an elastane yarn covered with a water-soluble yarn, and in that it then undergoes, once the item knitted, an aqueous treatment in such a manner as to make the covering water-soluble yarn disappear, whereby it is kept on the edge of the item p+q courses of bare knitted elastane which precede the normal basic knit. The numbers n, c, p and q are integers.

Due to the fact that this remaining knitted border is in pure elastane, even the p courses knitted on only one portion of the needles do not exert an unpleasant restraint for the wearer. Hence, the waistband is comfortable. Moreover, these p+q courses knitted in elastane prevent the item from running. Hence, thanks to the invention it is obtained a waistband in single layer with a short border practically invisible and undetectable by the wearer.

The water-soluble yarns, which may be dissolved in steam or preferably in hot water, are well known per se. They have already been used in the textile industry for separating assembly line knitted items, for example according to documents FR 2 272 213 and EP 0 037 629. Usually, yarns in polyvinyl alcohol (PVA) are used, for example sold under brands SOLVRON® or DURAFIL®.

The item obtained after this first stage of the method of the invention is a preform of the end product, which requires diverse treatments of which usually at least one confection treatment (for example for assembling the two tubes of the pair of tights) and one dyeing treatment.

According to a preferred method, the aqueous treatment to make the water-soluble yarn disappear is combined with the dyeing treatment, to make only one operation. The dyeing operation also operates the pre-fixation of the item. It is then followed by the confection treatment required for finishing the final item (in particular assembling together the two tubes of the pair of tights in order to form the panty part of the pair of tights), the confection then using dyed yarn since the preforms have already been dyed.

According to another method, the aqueous treatment is washing which allows at the same time to pre-fix the item dimensionally. It is then followed with the confection treatment for forming the finished item, the confection able to use ecru yarn as the item has not yet been dyed, and the confectioned item is then sent to be dyed.

The invention also relates to the intermediate product formed by knitting and before disappearance of the water-soluble yarn, namely the preform of the knitted tubular item.

More particularly, the invention relates to a preform of knitted tubular item comprising a start knitted on p first courses with skipped columns followed with q subsequent courses knitted on all the columns, after which the knit is the normal basic knit, characterized in that said p first courses and said q subsequent courses are made in an elastane yarn covered with a water-soluble yarn.

Finally, the invention relates to the end product obtained after disappearance of the water-soluble yarn. More particularly, the invention relates to a knitted tubular item comprising a start knitted on p first courses with skipped columns followed with q subsequent knitted courses on all the columns, after which the knit is the normal basic knit, characterized in that said p first courses and said q subsequent courses are made in an elastane yarn. It will be noted that the end product, the first p+q courses are in pure bare elastane, which it is very difficult, even impossible, to obtain without the method of the invention. Particularly, it is known by document EP 1 956 125 a knit of which the border is made by elastic polyurethane yarn based courses, but this yarn is surrounded with nylon, thereby making the border thus made not at all invisible as that of the invention.

Advantageously, the item is knitted in jersey on a circular knitting machine, for example a knitting machine of 400 needles with four feeders (n=400, c=4). The number p of first courses for knitting on only one portion of the needles is advantageously equal to 2 and the number q is higher than or equal to 1 and preferably higher than or equal to 2. Advantageously, the yarn used for the p first courses, an elastane yarn (for example Roica®) covered with a PVA yarn (for example Solvron®), is knitted 1 needle out of 4 the first course, 1 needle out of 2 the second, and on all the needles in the q (=2) subsequent courses of the border. The elastane yarn is advantageously a yarn of numbering less than 20 dtex, for example 17 dtex, and composed of many filaments, typically more than 20, for example 31, thus allowing it to hold the dye well and thereby be substantially undetectable to the eye on the border of the finished dyed item.

BRIEF DESCRIPTION OF THE DRAWING

Other features and advantages of the invention will become apparent upon reading the following description, given by way of non limiting indication, with reference to the accompanying drawing on which the unique FIG. 1 represents in a traditional manner the knitting diagram of a leg for a pair of tights.

DETAILED DESCRIPTION

The leg for a pair of tights of the invention may be knitted by using a knitting machine of the Lonati type 404MJ brand (4 feeders).

FIG. 1 shows a tubular leg 10 in several successive sections: a start part T to which the invention particularly relates, a waistband part C, a panty and thigh part S, an actual leg part J, a part SM called "mesh stop" and a toe part P. Knitting all the parts except for the start part T is what is called here a classic or normal basic knit for this type of item. It has been illustrated here for the four feeders 1, 2, 3, 4 in a polyamide based jersey stitch 6.6 (PA66) plated or not with elastane (R22). It could consist of other fibers, the invention not relating to making a normal knit.

The FIGURE details the knitting of the start part T and schematically shows the four courses of stitches 11, 12, 13, 14 prior to the aqueous treatment (right part, stage of the preform of the product) and after the aqueous treatment (left part, stage of the end product). According to the invention, the four feeders of the knitting machine are knitted in one same yarn 20 constituted of an elastane 21 of the Roica® brand 17 dtex of 31 monofilaments, covered in simple flat covering (SGP) of a water-soluble yarn 22 of PVA (polyvinyl alcohol) of the SOLVRON® brand. Such a covered yarn 20 is much easier to knit than a bare elastane yarn, which is very difficult to knit. In order to initiate knitting, it is not easy to knit directly on all the needles in simple feeder; it must be knitted gradually on a quarter of the needles, then on half the needles, then on all the needles. Hence, as the diagram shows, the knitting comprises a first knitted course 11, 1 needle out of 4 (hence on 100 needles out of the 400 needles of the knitting machine), leaving three skipped stitches on three adjacent columns between the formed stitches (each skipped column has been represented by a cross), then a second knitted course 12 1 needle out of 2 (hence 200 needles out of the 400 needles of the knitting machine), then finally two courses 13, 14 or more knitted on the 400 needles. All these courses 11-14 are thereby in elastane covered with water-soluble yarn, at the product preform.

Once a suitable preferably hot, aqueous treatment is carried out, the covering water-soluble yarn 22 is dissolved in water and is eliminated, leaving the elastane 21 bare, in such a manner that the stitches represented on the left part of the FIGURE are obtained, where the first courses of stitches are in bare elastane, first 1 needle out of 4, then 1 needle out of 2, then on all the needles. These courses 11-14 of bare elastane are easily stretched, even for the first two courses which are not knitted on all the needles, due to the fact that the elastane is pure and highly elastic. These first courses, here four courses, hardly visible to the naked eye, do not cause any discomfort to wear and then allow continuing normal knitting. The waistband C may hence be knitted in a single thickness, like the rest of the pair of tights.

The invention claimed is:

1. A method of producing a knitted tubular item on a circular knitting machine comprising a plurality of needles and one or more feeders, the method comprising:

knitting a first plurality of courses of elastane yarn covered with a water-soluble yarn using less than all of the plurality of needles;

after knitting the first plurality of courses, knitting a second plurality of courses of elastane yarn covered with a water-soluble yarn using all of the plurality of needles;

after knitting the second plurality of courses, knitting a third plurality of courses; and once the tubular item has been knitted, applying an aqueous treatment to the first plurality of courses and the second plurality of courses in such a manner as to make the water-soluble yarn disappear, leaving a bare knitted elastane at the first plurality of courses and the second plurality of courses.

2. The method according to claim 1, further comprising: applying a dyeing treatment to at least a portion of the knitted tubular item in a combined operation with the aqueous treatment.

3. The method according to claim 1, wherein the aqueous treatment for making the water-soluble yarn disappear comprising washing the knitted tubular item.

4. A preform of a circularly knitted tubular item comprising:

a border region comprising a first plurality of courses followed by a second plurality of courses, each of the first plurality of courses comprising less yarn than each of the second plurality of courses; and a body region comprising third plurality of courses, wherein the first plurality of courses and the second plurality of courses comprise an elastane yarn covered with a water-soluble yarn.

5. A circularly knitted tubular item comprising a border region comprising a first plurality of courses followed by a second plurality of courses, each of the first plurality of courses comprising less yarn than each of the second plurality of courses; and a body region comprising a third plurality of courses, wherein the first plurality of courses and the second plurality of courses consist of bare, uncovered elastane yarn.

6. The knitted tubular item according to claim 5, wherein the elastane yarn is of a numbering less than 20 dtex.

7. The knitted tubular item according to claim 5, wherein the elastane yarn is composed of more than 20 filaments.

8. The method according to claim 1, wherein knitting the first plurality of courses comprises knitting at least one course using one out of every four needles.

9. The method according to claim 1, wherein knitting the first plurality of courses further comprises knitting at least one course using one out of every two needles.

10. The method according to claim 1, wherein the water-soluble yarn comprises a PVA yarn.

11. The method according to claim 1, wherein the first plurality of courses comprises at least two courses, and wherein the second plurality of courses comprises at least two courses.

12. The method according to claim 1, wherein the elastane yarn is of a numbering less than 20 dtex and is composed of more than 20 filaments.

13. The method according to claim 1, wherein knitting the third plurality of courses comprises knitting at least one course of a yarn comprising polyamide.

14. The method according to claim 1, wherein knitting the third plurality of courses comprises using at least a portion of the plurality of needles to implement a jersey stitch knitting pattern.

15. The preform according to claim 4, wherein the water-soluble yarn comprises a PVA yarn.

16. The preform according to claim 4, wherein the elastane yarn is of a numbering less than 20 dtex and is composed of more than 20 filaments.

17. The preform according to claim 4, wherein the third plurality of courses comprises at least one course including a polyamide yarn knitted in a jersey stitch pattern.

18. The knitted tubular item according to claim 5, wherein the elastane yarn is of a numbering less than 20 dtex and is composed of more than 20 filaments.

19. The knitted tubular item according to claim 5, wherein the third plurality of courses comprises at least one course including a polyamide yarn knitted in a jersey stitch pattern.

* * * * *